United States Patent [19]

Deeg

[11] Patent Number: 4,918,271

[45] Date of Patent: Apr. 17, 1990

[54] PUSHBUTTON TYPE KEYBOARD SWITCH

[75] Inventor: Reinhard Deeg, Keltern, Fed. Rep. of Germany

[73] Assignee: Standard Elektric Lorenz AG, Stuttgart, Fed. Rep. of Germany

[21] Appl. No.: 303,105

[22] Filed: Jan. 24, 1989

Related U.S. Application Data

[63] Continuation of Ser. No. 723,223, Apr. 15, 1985, abandoned.

[30] Foreign Application Priority Data

Apr. 19, 1984 [DE] Fed. Rep. of Germany ..... 3414909

[51] Int. Cl.[4] ..... H01H 3/12

[52] U.S. Cl. ..... 200/344; 200/345; 200/517

[58] Field of Search ..... 200/340, 159 B, 341, 200/344, 345, 517

[56] References Cited

U.S. PATENT DOCUMENTS

| | | | |
|---|---|---|---|
| 2,040,919 | 5/1936 | Caldwell | 200/159 B |
| 3,663,780 | 5/1972 | Godbeck . | |
| 3,707,609 | 12/1972 | Dapot et al. | 200/159 B |
| 3,721,778 | 3/1973 | Seeger, Jr. et al. | 200/159 B |
| 3,916,131 | 10/1975 | Golbeck et al. . | |
| 4,354,081 | 10/1982 | Serras-Paulet. | 200/340 |

FOREIGN PATENT DOCUMENTS

| | | | |
|---|---|---|---|
| 0025629 | 3/1981 | European Pat. Off. | 200/340 |
| 214479 | 12/1982 | Fed. Rep. of Germany . | |
| 1469594 | 4/1977 | United Kingdom . | |
| 2046996 | 11/1980 | United Kingdom | 200/340 |

*Primary Examiner*—Linda J. Sholl

*Attorney, Agent, or Firm*—Christie, Parker & Hale

[57] ABSTRACT

A low-profile keyboard switch having an improved guide structure for guiding the vertical motion of the keys. Each key assembly comprises a guide member and a key including a keypad, a downwardly projecting central plunger and a downwardly projecting leg or skirt, the inner dimension of the leg or skirt being greater than the outer dimension of the guide member. The guide member is provided with a generally horizontal central opening adapted to receive the plunger and generally vertical peripheral walls which serve as a bearing surface for slide cams which project inwardly from the inner surface of the leg or skirt. Together the contact between the key, the central opening and the peripheral walls assure a vertical orientation for the key and a reduced resistance to key motion.

4 Claims, 7 Drawing Sheets

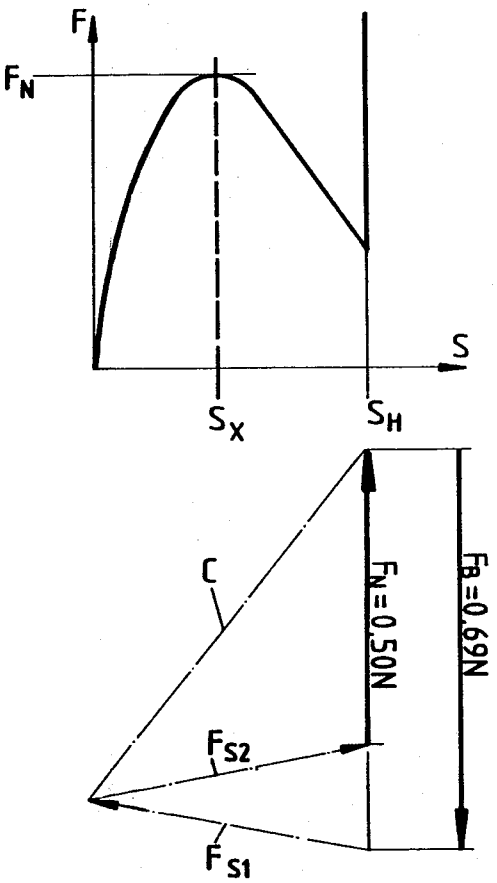
Fig.1
PRIOR ART
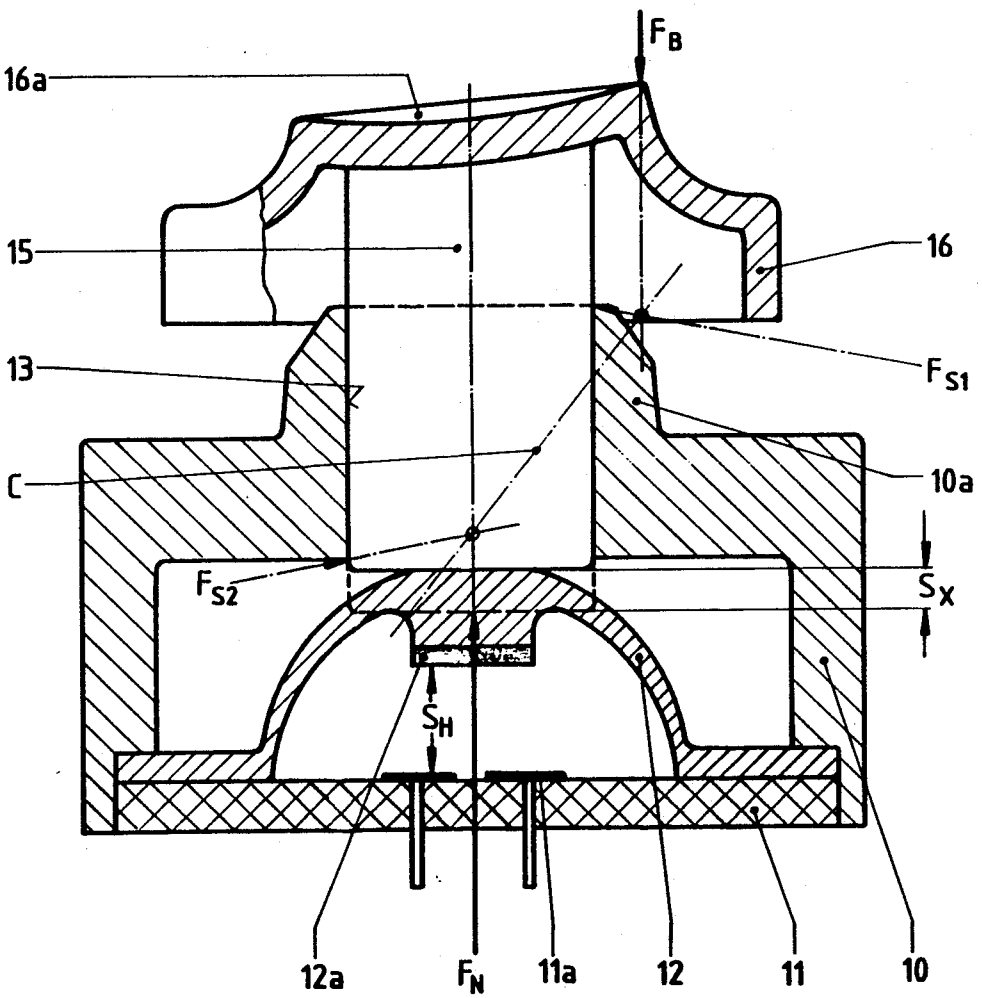

PUSHBUTTON TYPE KEYBOARD SWITCH

CROSS-REFERENCE TO RELATED APPLICATIONS

This is a continuation of application Ser. No. 06/723,223, filed 4/15/85 now abandoned.

BACKGROUND OF THE INVENTION

The invention relates to keyboard switches and is directed more particularly to a low-profile keyboard switch having an improved guide structure.

Prior to the present invention pushbutton keyboard switches have included keys having central plungers which were guided along relatively long tubular channels or guides formed in the cover surface of the keyboard switch housing, as is disclosed, for example, in German Patent No. 33 02 793. The lengths of these plungers and guides have been thought to be necessary in order to prevent the actuating force of the key from increasing noticeably when the key is pressed at a point away from its center. Such an increase in force results from the tilting of the plunger in its guide.

According to prevailing ergonomic standards for alphanumeric keyboards, e.g., video work stations, the average overall height of the keyboard must not exceed 30 mm. Because of the just described tilting problem, it has not been possible to meet these standards with keyboard switches of the above mentioned type.

SUMMARY OF THE INVENTION

In accordance with the present invention there is provided an improved keyboard switch of the aforementioned type which has a low profile and which may be operated with minimal force.

Generally speaking, the present invention contemplates a keyboard in which each key assembly includes a key having a downwardly projecting central plunger and a downwardly projecting leg or skirt, and a guide member having a substantially horizontal central opening adapted to receive the plunger and a substantially vertical outer surface adapted to serve as a bearing surface. In the preferred embodiment the inner dimension of the skirt is larger than the outer dimension of the guide member and the spaces between the skirt and the guide member are occupied by horizontally projecting slide cams. In use, the interior of the central opening and the exterior surface of the guide member serve as horizontally spaced vertical guide surfaces which guide the vertical motion of the key.

The advantages of the present invention result from the fact that the key is provided with a improved guide structure which allows the length of the plunger guide to be greatly reduced and which causes any off-center actuation of the key to produce only a slight increase in the key actuating force.

DESCRIPTION OF THE DRAWINGS

The invention will be described with reference to the accompanying drawings, in which:

FIG. 1 is an enlarged cross sectional view of a first type of prior art keyboard switch;

DESCRIPTION OF THE PREFERRED EMBODIMENTS

Figure 2:
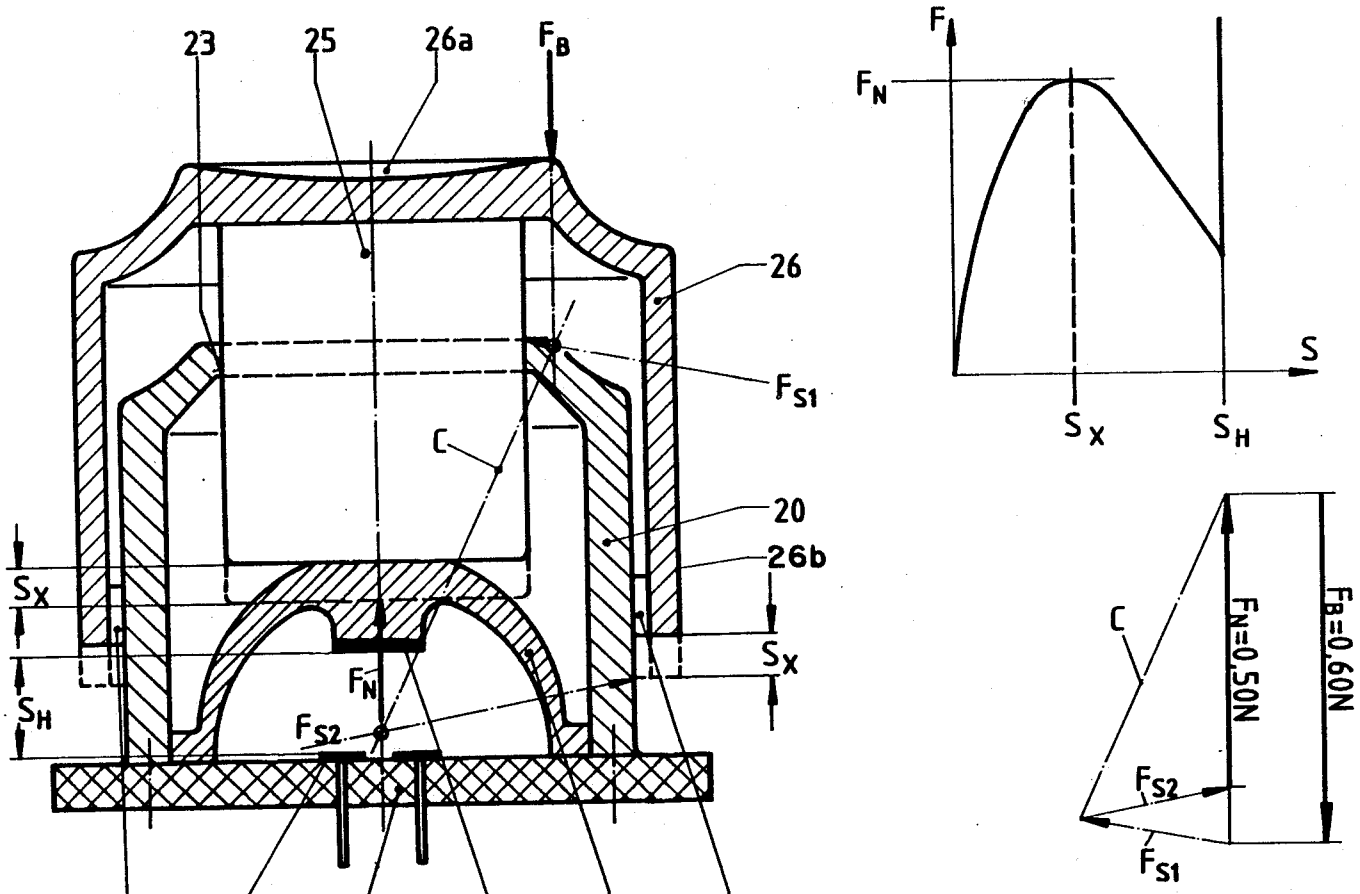
FIG. 2 is an enlarged cross sectional view of a first embodiment of a keyboard switch constructed in accordance with the invention.

Referring to FIG. 1, there is shown a cross sectional view of a conventional type of keyboard switch assembly. This assembly includes a keyboard switch housing or guide 10 having an open bottom which is closed by a bottom plate 11 that supports contacts 11*a*. Resting on bottom plate 11 is a rubber-elastic switching dome 12 which has a contact bead 12*a* in its center. Resting on the top of dome 12 is a key plunger 15 which is vertically displaceable in a tubular guide channel 13 formed within housing 10. The length of this channel is increased by providing a projecting part 10*a* which extends upwardly from the upper surface of housing 10. The plunger 15 is headed by a keypad 16 which has an actuating surface 16*a*.

Upon actuating the key in the center of the surface 16*a*, with the exception of small frictional forces, only the counterforce of the switching dome 12 has to be overcome. As can be seen from the force-distance diagram, the counterforce at first increases as the key moves, reaching a maximum value $F_N$ after travelling distance $S_X$ and then decreases again, owing to the collapse of switching dome 12, as it travels the remaining distance $S_H$. This switch travel is ended as soon as the contact bead 12*a* comes into contact with contacts 11*a*.

During actual use, keys are almost always pressed at points that are off center, particularly when they form part of a keyboard array. In such cases the actuation force $F_B$ may act upon the rim portion of the surface 16*a*, as is shown in FIG. 1. If, as shown in FIG. 1, actuation force $F_B$ acts at the outer rim portion of the surface 16*a* of keypad 16 then the key element including plunger 15 and keypad 16 is subjected to a tilting moment, causing one side of plunger 15 to be pressed against the upper portion of channel 13 and the other side of plunger 15 to be pressed against the lower side of channel 13. At the time when dome 12 is in the position which offers the greatest counterforce $F_N$, the resisting forces $F_{S1}$ and $F_{S2}$ which are associated with these contacts manifest themselves as shown in the force diagram and act at angles which are substantially determined by the types of materials used. In order to enable a better comparison, all examples to be described hereinafter are based on the same assumed conditions. The intersection of resisting force vector $F_{S1}$ and the actuation force vector $F_B$, and the intersection of resisting force vector $F_{S2}$ and dome force vector $F_N$ are connected by the so-called Culmann's straight line C. The angular position of such a straight line is a direct measure of the increase of the actuation force $F_B$, with force $F_B$ increasing as straight line C becomes more nearly horizontal.

From the triangle of forces shown in FIG. 1, the increase of actuation force $F_B$, as compared to the dome force $F_N$, is calculated at 0.15N, which means an increase in force of almost 40% in this case.

FIG. 2 is a cross sectional view of a first embodiment of the keyboard switch of the invention in which both keypad 26 and plunger 25 are guided. FIG. 2 shows a keyboard switch assembly having a keyboard switch housing or guide member 20 which may be circular and which has an open bottom. The underside of housing 20 is closed by a bottom plate 21 having contacts 21*a*. Bottom plate 21 supports a rubber-elastic switching dome 22 which is provided with a contact bead 22*a* at its center. Resting on the top of dome 22 is a plunger 25 which is capable of sliding vertical motion within a central opening 23 defined by member 20. Significantly, the vertical dimension of opening 23 is substantially equal to the thickness of material that forms member 20. Extending downwardly from upper end of key 26 is a generally bell-shaped peripheral member or skirt 26*b* which fits over cylindrical guide member 20. The inner surface of skirt 26*a* is spaced a small distance apart from the outer surface of member 20 and is generally parallel thereto. This skirt extends down so far that its lower rim portion, in the actuated state of the keyboard switch, will not touch bottom plate 21. Positioned along the inside edge of this lower rim are at least four crosswisely disposed slide cams or members 28 which, with the exception of a small clearance space, occupy the space between guide member 20 and skirt 26*b*. Instead of a discrete number of slide cams 28, a continuous slide ring (not shown) may be used.

If, as shown in the force diagram of FIG. 2, an actuation force $F_B$ acts at the outer rim portion of actuating surface 26*a* of key 26, then the plunger 25 will press against the right hand side of central guide hole 23. At the same time, one or more slide cams 28 will press against the smooth outer surface of guide member 20.

After travelling through distance $S_X$, the counterforce of the dome 22 will have reached its maximum value $F_N$, as can be seen from the force-distance diagram. At this time, the resisting force vectors $F_{S1}$ and $F_{S2}$ shown in FIG. 2 appear at the indicated points. Through the intersection points with the force vectors $F_B$ or $F_N$ respectively, there is also drawn a Cullmann's straight line C. Compared with the straight line C shown in FIG. 1, this line will be seen to be substantially steeper. As is shown in the graphical calculation in the force triangle next to this diagram, the actuation force $F_B$. compared to the dome force $F_N$, has only increased by 0.1N and, consequently, is only about half as great as with the keyboard switch shown in FIG. 1.

Figure 3:
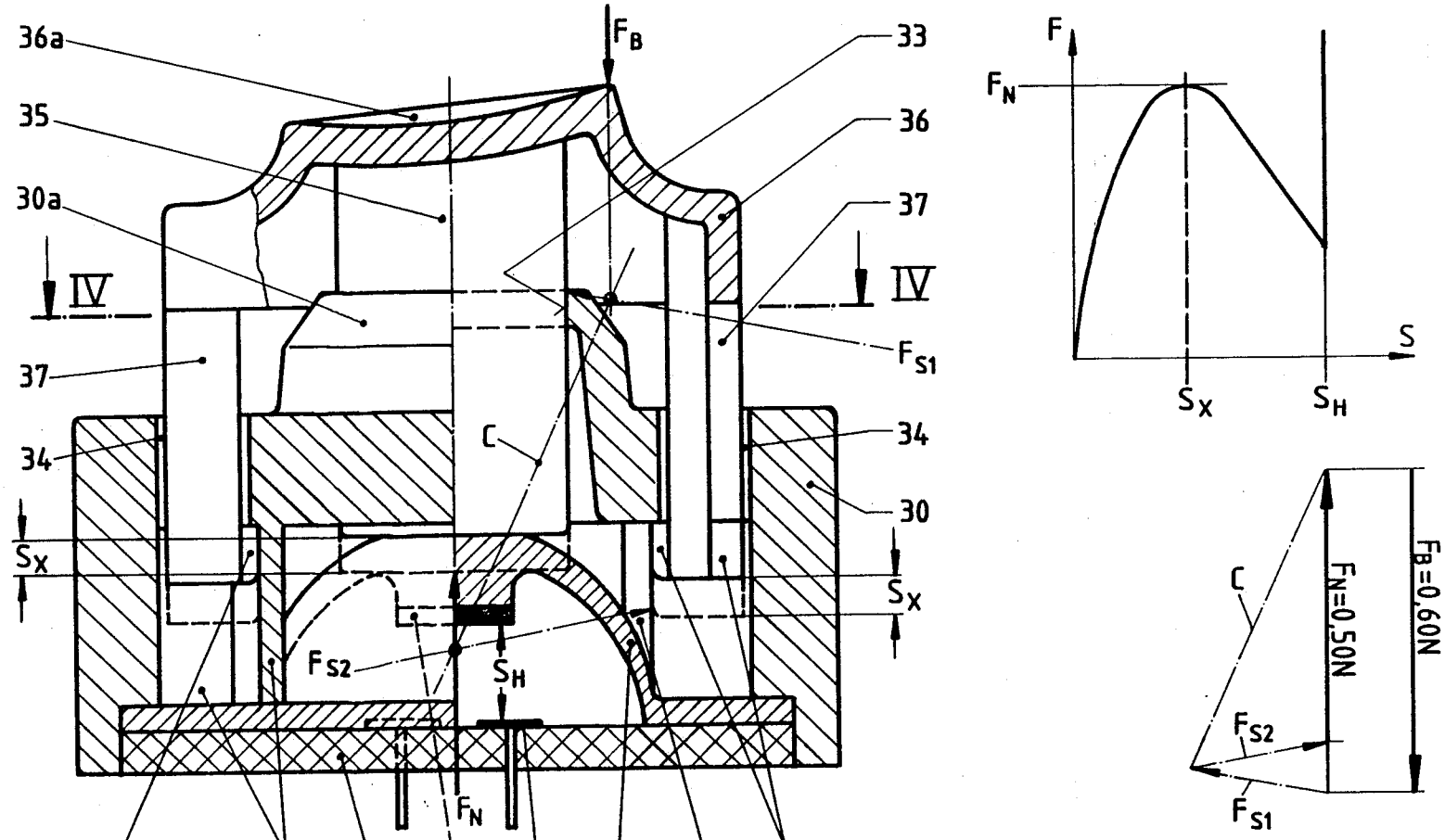
FIGS. 3 and 4 are enlarged cross sectional views of a second embodiment of a keyboard switch constructed in accordance with the invention.
Figure 4:
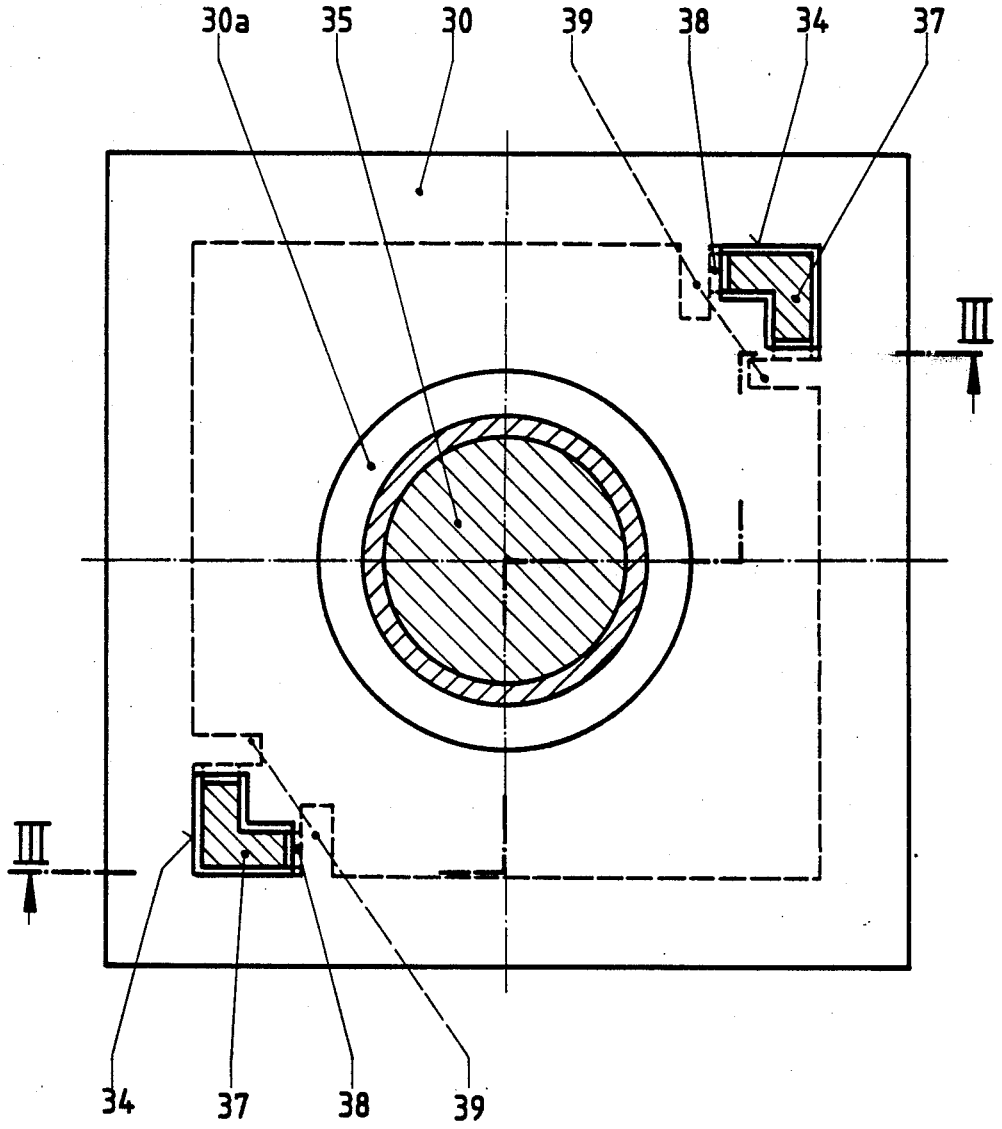

FIGS. 3 and 4 are cross sectional views of a second embodiment of the keyboard switch of the invention in which both the plunger 35 and the outer edge of key 36 are guided. FIGS. 3 and 4 show a keyboard switch having a square guide member 30 (FIG. 4) and a square key 36 having an actuating surface 36*a*. FIG. 3 is a sectional view taken on line III—III of FIG. 4. Member 30 has an open bottom and is closed by a bottom plate 31 which has contacts 31*a*. A rubber-elastic switching dome 32 which, via the bottom plate 31, is firmly connected to member 30, rests on the bottom plate 31. Above the contacts 31*a* and at a spacing corresponding to the switch travel $S_H$, the switching dome 32 is provided with a contact bead 32*a* at its center. The top of dome 32 is in contact with the plunger 35 which is vertically guided by a part 30*a* which projects upwardly from the top of guide member 30. It should be noted that only the thin upper portion of the part 30*a* is in contact with plunger 35.

From diagonally opposite corners of square keypad 36 there extends, in generally parallel relationship to plunger 35, at least two flexurally stiff peripheral members or legs 37 which are resistant to bending and have L-shaped cross sections (see FIG. 4). These legs are preferably flush with the outer corners of keypad 36. In the top of guide member 30, there are provided passages 34 which have cross sectional shapes that are similar to those of legs 37 and which allow legs 37 to project into the interior hollow space of the keyboard switch assembly. As will be seen from FIG. 4, two guide ridges 39 are provided in the free corners of the guide member in generally parallel relationship to the faces of legs 37. Each of legs 37 has at least one horizontally projecting slide cam 38 which, except for a small clearance space, is in contact with the guide ridges 39. As will be seen from FIG. 3, these guide ridges 39 are somewhat recessed inwardly with respect to passages 34, so that a step-shaped offset or shoulder results.

When the key is inserted, the slide cams 38 snap into place below this offset. In this way the key is, in a simple manner, detachably locked inside the keyboard switch assembly. In its normal position, plunger 35 rests lightly on the top of dome 32.

If, as shown in FIG. 3, an actuation force $F_B$ acts at the outer rim portion of actuating surface 36*a* of key 36, then the plunger 35 Will press against the right hand side of central guide hole 33. At the same time, one or more of slide cams 38 will press against the inner surfaces of respective guide ridges 39.

After travelling through distance $S_X$, when the counterforce of the dome 32 reaches its maximum value $F_N$ (see force-distance diagram), the resisting forces $F_{S1}$ and $F_{S2}$ shown in FIG. 3, appear at the indicated points. The Culmann's straight line C drawn through the previously mentioned intersection points assumes the same angle as in the example of FIG. 2, so that the same values are calculated, as can be seen from the force triangle of FIG. 3.

In the case of keyboard switches employing keypads which are several times as wide as those discussed earlier and which are shown in FIGS. 5 and 6 (and which each only have one plunger) substantially higher tilting moments occur as a result of the greater overhang of the keypad.

Figure 5:
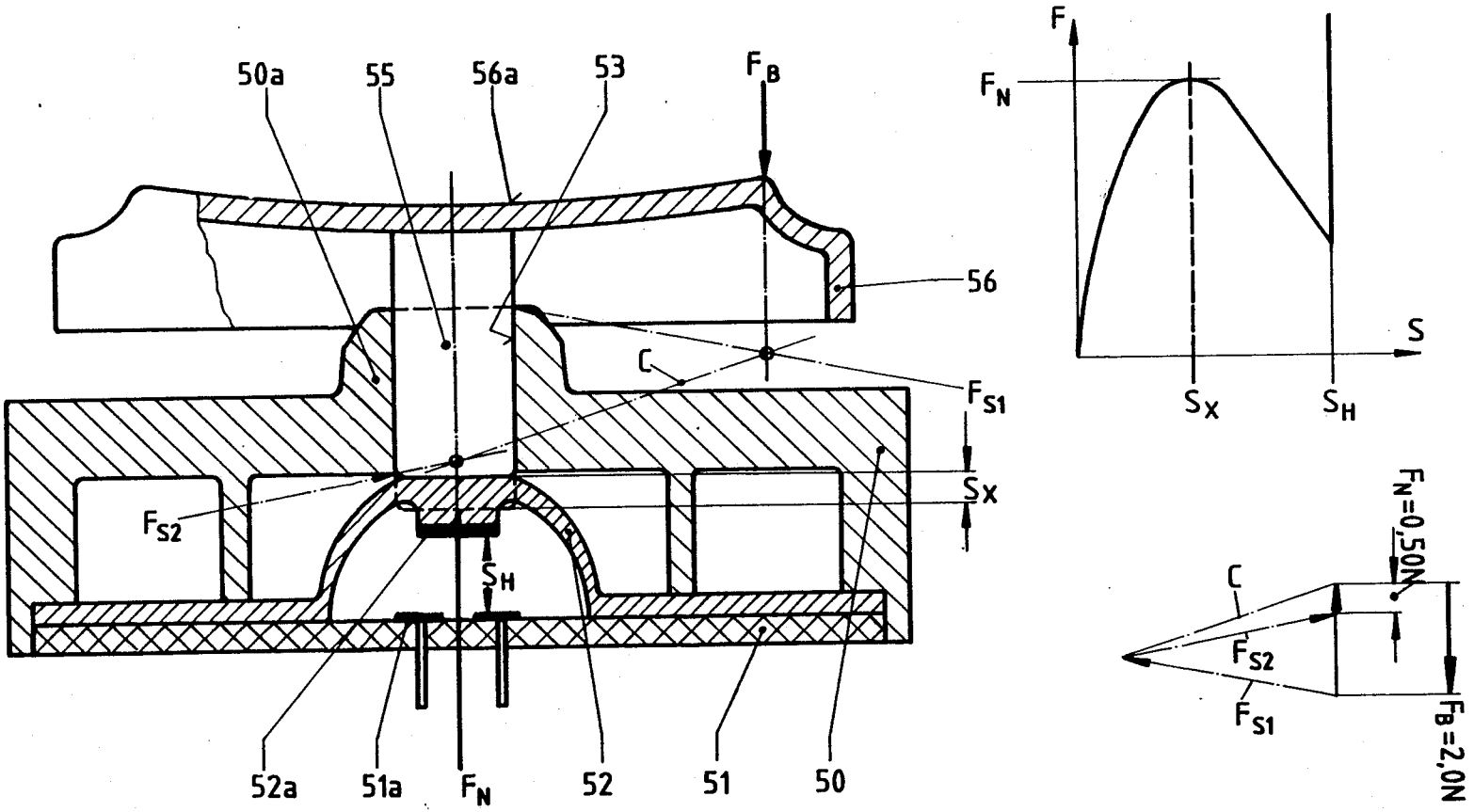
Fig.5 PRIOR ART
FIG. 5 is an enlarged cross sectional view of a second type of prior art keyboard switch.

FIG. 5 is a cross sectional view of another type of prior art keyboard switch. The keyboard switch housing 50 has a width roughly corresponding to that of the keypad and has an open bottom. Inside the housing 50 there is located a switching dome 52 which rests on a bottom plate 51 closing the housing 50 from below. As with all previously described embodiments, contacts 51*a* and a contact bead 52*a* oppose each other at the spacing of the switch travel $S_H$. Resting on the top of dome 52 is a plunger 55 which has a long guide channel 53 extending through the entire thickness of housing 50, including a portion 50*a* which extends upwardly from the top thereof. To the plunger 55 there is connected an extra wide keypad 56 which has an actuating surface 56*a* that extends across its entire width.

If, as shown in FIG. 5, an actuation force $F_B$ acts at the outer rim of the surface 56*a* of keytop 56, a high tilting moment will occur which creates a high magnitude resisting forces $F_{S1}$ and $F_{S2}$. When the counterforce produced by switching dome 52 reaches its maximum value $F_N$ after travelling distance $S_X$, this tilting moment may be so great as to lead to a breakage of plunger 55. This is because, according to the force triangle and owing to the nearly horizontally extending Culmann's straight line C, the actuation force $F_B$ necessary to displace key 55/56 with respect to the dome force $F_N$. increases by 1.5N, which corresponds to a 400% increase in force.

Figure 6:
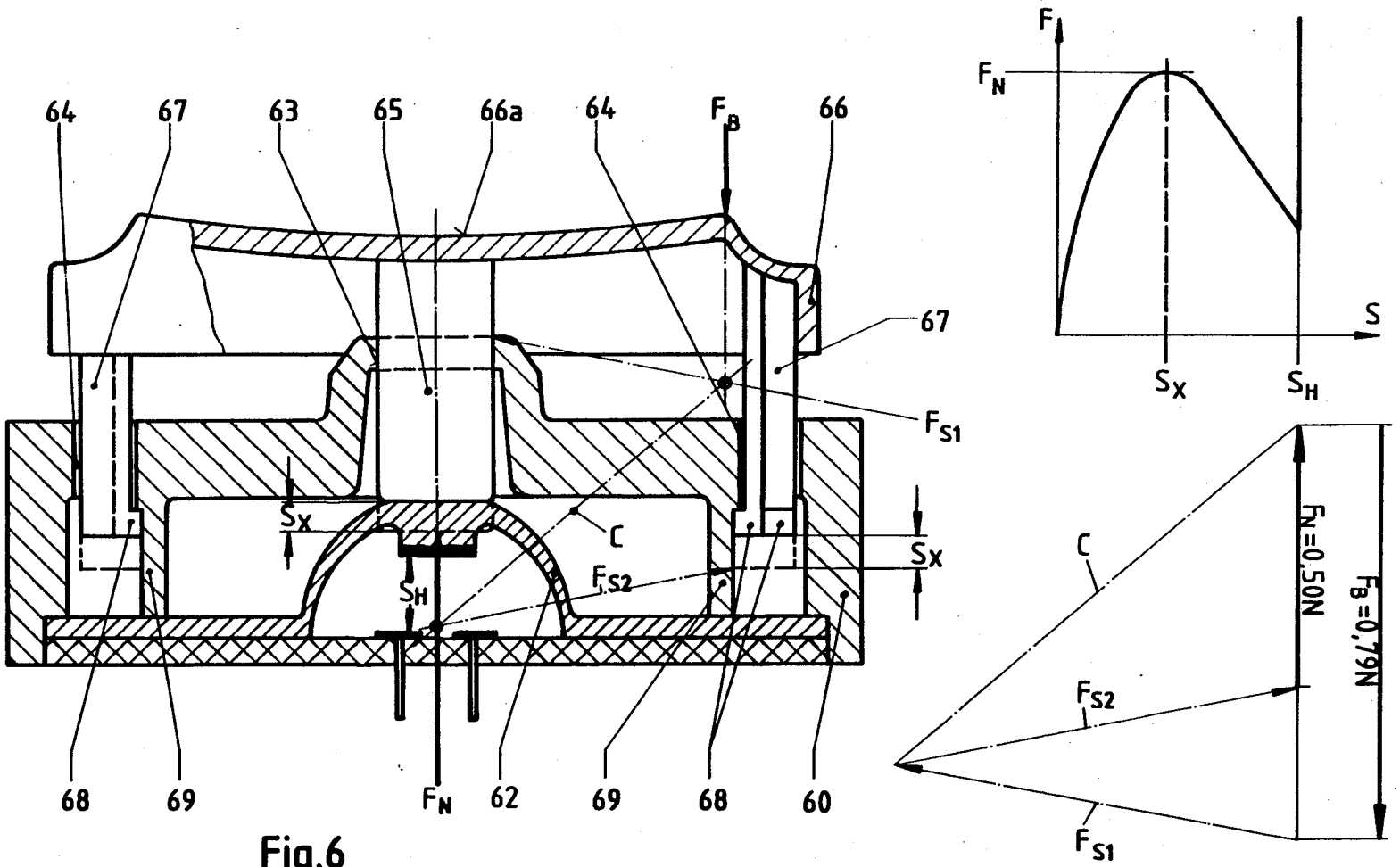
FIG. 6 is an enlarged cross sectional view of a third embodiment of a keyboard switch constructed in accordance with the invention.

Compared to this, the keyboard switch shown as a third embodiment of the invention in FIG. 6 has substantially more favorable force values.

Since the construction of the keyboard switch embodiment of FIG. 6 corresponds to that of the embodiments shown in FIGS. 3 and 4, the structure of the keyboard switch of FIG. 6 will not be discussed in detail herein. The only difference is that the legs 67 are not flush with the outer corner of the keypad 66, but are recessed somewhat toward the inside thereof. Accordingly, the top side of the housing 60 is provided with passages for legs 67. The guide ridges 69 which can be seen in FIG. 6 are chamber walls which separate the actual switch area from the guide area so that any dirt or humidity penetrating through the passages 64 is kept away from the switch contacts. In the embodiment shown in FIG. 3, it is likewise possible to prevent dirt penetration by extending guide ridges 39 to form a closed square frame.

If, as shown in FIG. 6, an actuation force $F_B$ acts at the outer rim of surface area 66*a* of keypad 66, then the plunger 65 is in contact with the right hand side of central guide hole 63. At the same time, one or more of the slide cams 68 will press against the associated guide ridges 69.

When the counterforce of the switching dome 62 reaches its maximum value $F_N$ after travelling distance $S_X$. as shown in the force-distance diagram of FIG. 6, resisting forces $F_{S1}$ and $F_{S2}$ appear at the indicated points. The Culmann's straight line C which is drawn through the previously mentioned intersection points, assumes a substantially steeper angle than the corresponding line C of FIG. 5. As is evident from the graphical calculation in the associated force triangle, the increase in actuation force $F_B$ is 0.9N, about 15% of the value associated with the embodiment of FIG. 5. This comparison clearly shows the effect of the keypad guide member in addition to the effect of the plunger guide member.

As mentioned previously, flat keyboard switches are required primarily in connection with alpha-numeric keyboards. Whereas earlier keyboards Were mainly composed of individual key assemblies, it has recently become common practice to use keyboard frames in which all key assemblies share a common housing. The bottom surfaces of such keyboard frames are subdivided into a great number of compartments each of which contains the contacts of one switch.

Figure 7:
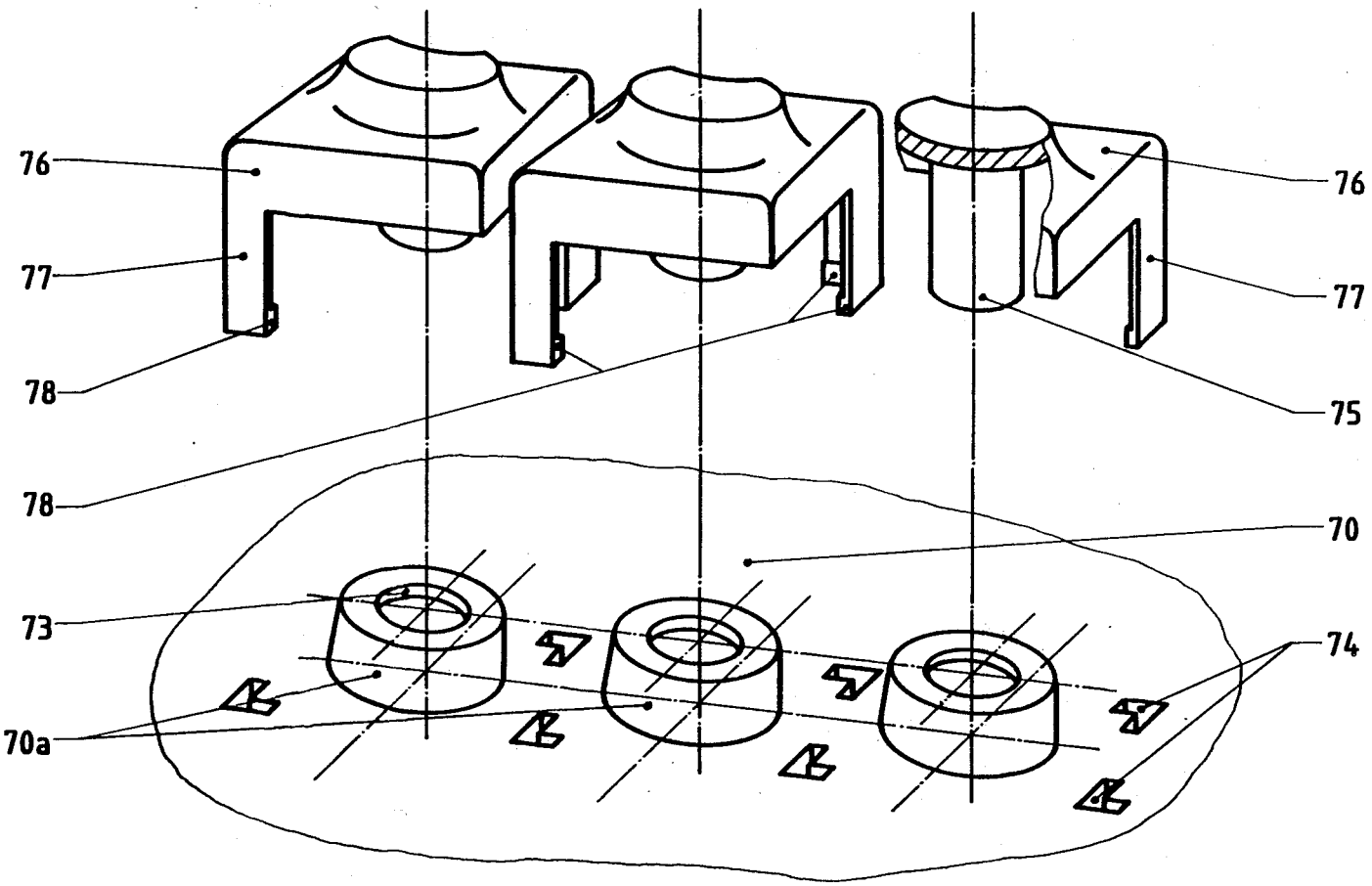
FIG. 7 is an exploded partial perspective view of a part of the keyboard frame of FIG. 3 together with the associated keyboard switch elements.

Referring to FIG. 7, there is shown a part of an exploded perspective view of such a keyboard frame 70. In FIG. 7 the guiding facilities are visible from the outside because the key elements 75–77 are shown in the upper part of the drawing. These key elements 75–77 correspond to those of the embodiment described in connection with FIG. 3. Each key element consists of a plunger 75 formed integrally with a keypad 76. The keytops are provided with diagonally opposite legs 77 having L-shaped cross sections which are flush with the outer corners of the keytop 76. On the inner surfaces of the ends of these legs, slide cams 78 are disposed. The keyboard frame 70 comprises parts 70*a* which project upwardly from the top surface with guide holes 73 for receiving respective plungers 75. In order to receive members 77 keyboard frame 70 is provided with passages 74 having cross sectional shapes corresponding to those of legs 77. Together with the interior compartment walls, these passages serve as guides for legs 77.

What is claimed is:

1. A pushbutton-type switch comprising:

(a) a key having a downwardly projecting central plunger and at least two generally diametrically opposed downwardly projecting peripheral leg members, each of said leg members having a generally L-shaped horizontal cross section;

(b) an upwardly projecting guide member having a generally vertical outer surface and defining a generally horizontal central opening for slidingly receiving said plunger therein, the edge of said opening having a length in the direction of travel of said plunger which is small in relation to that of the plunger, said guide member having a generally square horizontal cross section with said leg members in proximate coacting relation to diagonally opposite corners thereof; and (c) slide means on the ends of said leg members for slidingly engaging the corners of said guide member, the contact between the plunger and said opening and between said leg members and the engaged corners of said guide member serving to limit the degree to which the key can move in a direction which deviates from vertical.

2. A pushbutton-type switch comprising:

(a) a key having a downwardly projecting central plunger and at least two generally diametrically opposed downwardly projecting peripheral leg members, each of said leg members having a generally L-shaped horizontal cross section;

(b) a keyboard frame having a generally planar portion and an upwardly projecting generally inverted cup-shaped portion having a generally horizontal central opening for slidingly receiving said plunger therein, the edges of said opening having a length in the direction of travel of said plunger which is small in relation to that of the plunger, said planar portion having at least two generally L-shaped passages matingly aligned for coactingly receiving the ends of said leg members therein; and (c) slide means on the ends of said leg members for slidingly engaging surfaces of said passages, the contact between the plunger and said opening and between said leg members and the engaged surfaces of said passages serving to limit the degree to which the key can move in a direction which deviates from vertical.

3. The switch of claim 2, in which the leg members are disposed in the corners of the key and terminate flush with the outer contour of the key, and in which the slide means are slide cams disposed on the facing surfaces of the leg members.

4. A pushbutton-type switch comprising:

a key having an actuating surface, a central plunger projecting downwardly from said surface and at least one peripheral member projecting downwardly from said surface to a position below the bottom of said central plunger;

an upwardly projecting guide member having a generally vertical outwardly facing lower bearing surface and defining a generally horizontal central opening in an upper portion of the guide member above said lower bearing surface for slidingly receiving said plunger, the periphery of said opening forming a generally vertical inner bearing surface having a length in the direction of travel of said plunger which is small in relation to the length of the plunger; and (c) a slide member projecting horizontally inward from said peripheral member adjacent the lower end thereof for sliding along the lower bearing surface of the guide member, said slide member having a length in the direction of travel of said plunger which is small in relation to the vertical extent of the lower bearing surface, said outwardly facing lower bearing surface being vertically spaced from said inner bearing surface so that the contact between the plunger and the inner bearing surface cooperates with the contact between said slide member and the lower bearing surface to limit the degree to which the key can tilt from vertical.

* * * * *